United States Patent [19]

Sullivan et al.

[11] 4,136,387

[45] Jan. 23, 1979

[54] GOLF CLUB IMPACT AND GOLF BALL LAUNCHING MONITORING SYSTEM

[75] Inventors: Paul F. Sullivan, Acushnet; Francis deS. Lynch, Mattapoisett; William Gobush, North Dartmouth; Hoyt C. Hottel, Jr., Mattapoisett, all of Mass.

[73] Assignee: Acushnet Company, New Bedford, Mass.

[21] Appl. No.: 832,564

[22] Filed: Sep. 12, 1977

[51] Int. Cl.[2] ..... G06G 7/48; A63B 43/00

[52] U.S. Cl. ..... 364/410; 73/167; 273/185 R; 364/525

[58] Field of Search ..... 364/410, 565, 463, 525; 73/12, 13, 88 A, 167; 273/32 A, 199 R, 62, 213, 233, 176 FA, 235 B, 77 R, 162 D, 87 G, 87 H, 102.2 R, 105.5, 183, 185; 356/27, 28, 256

[56] References Cited

U.S. PATENT DOCUMENTS

| | | | |
|---|---|---|---|
| 3,359,005 | 12/1967 | Cameron | 273/186 R |
| 3,364,751 | 1/1968 | Cornell et al. | 73/13 |
| 3,513,707 | 5/1970 | Russell et al. | 273/176 FA |
| 3,630,601 | 12/1971 | Lebovee | 356/256 |
| 3,633,007 | 1/1972 | Sanders | 364/410 |
| 3,671,724 | 6/1972 | Sanders | 364/410 |
| 3,804,518 | 4/1974 | Meyr | 364/565 |
| 3,935,669 | 2/1976 | Potrzuski et al. | 273/213 |
| 4,041,293 | 8/1977 | Kihlberg | 364/565 |

*Primary Examiner*—Charles E. Atkinson
*Assistant Examiner*—Errol A. Krass
*Attorney, Agent, or Firm*—Eyre, Mann, Lucas & Just

[57] ABSTRACT

Electro-optical sensors measure the location of a plurality of spots on the surface of a golf club head or a golf ball at a minimum of two precisely spaced points in time. The two time points for the club head are just prior to impact with the golf ball. The two time points for the golf ball are just after impact by the club head. From the apparent displacements of the plurality of spots between measurements, the apparatus determines in substantially real time the velocity of the club head or ball and the spin about orthogonal axes.

12 Claims, 3 Drawing Figures

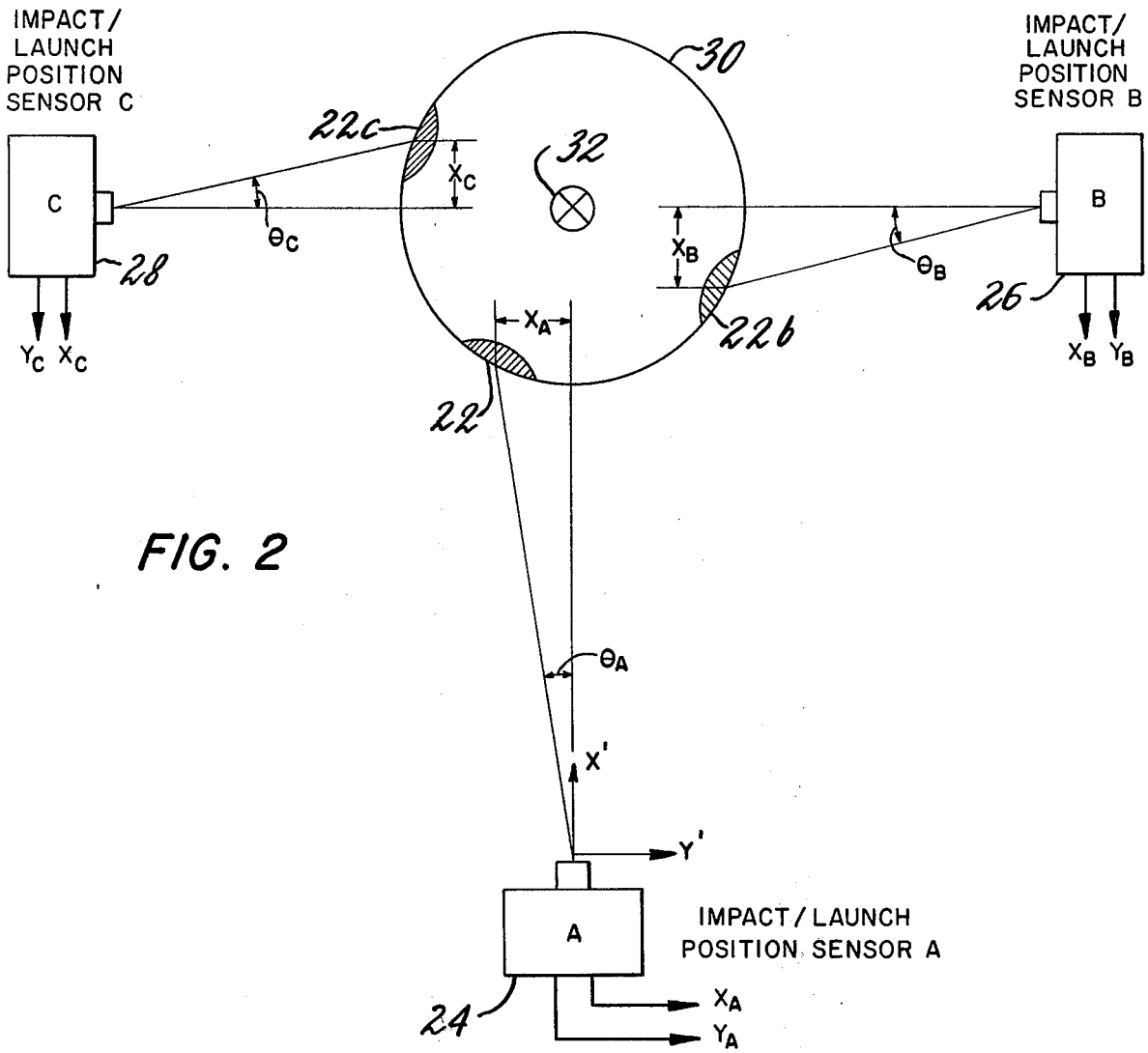
FIG. 2
FIG. 3
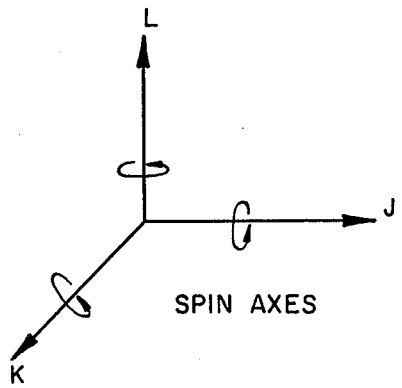

GOLF CLUB IMPACT AND GOLF BALL LAUNCHING MONITORING SYSTEM

BACKGROUND OF THE INVENTION

Athletes, and particularly golfers, are interested in improving their game performance. One of the elements in golf performance in the through-the-air carry distance and the directional accuracy resulting from the golf drive.

As disclosed in U.S. Patent application Ser. No. 626,712 filed Oct. 29, 1975 now U.S. Pat. No. 4,063,259, owned by the assignee of the present invention, applicants have discovered through wind-tunnel tests and controlled mechanical driving of golf balls that they can predict the landing point of a driven golf ball with great accuracy if they are given the values of ball velocity, flight direction and ball spin in the immediate post-launch time period. In addition, applicants can diagnose problems in the golfer's swing if they are given the velocity, direction and rotary motions of the golf club head in the immediate pre-launch time period.

There are known monitoring devices for determining the position of a plurality of points on a moving object at two closely spaced points in time which can advantageously be used in the present invention to provide the required velocity and rotation data useable in making such performance predictions.

SUMMARY OF THE INVENTION

The present invention suitably uses at least two electro-optical kinematic monitors to detect the apparent positions of at least three non-collinear spots on an object at two closely spaced points in time. If the object being monitored is a golf club head, the two time points immediately precede impact of the club with the ball. If the object is a golf ball the two time points closely follow the impact of the golf club. It will be understood that only one time point is necessary if the original orientation of the ball on the tee is known. It will be appreciated that in certain instances where the object is of the proper geometry, notably spherical, one of the "spots" can be the whole object image in which case it is only necessary to have two non-collinear spots added to the object itself.

At each electro-optical sensing location, an accurate bi-angular measurement is made of spots on the ball or club. A vector can then be defined from each sensor passing through the spot which it detects. Given the knowledge of the geometric relationships of the two electro-optical sensors and the location of the monitored spots on the surface of the object being monitored, the object center and angular orientation are uniquely and accurately determined at each of the two time points.

A displacement calculator in the present invention determines the direction in which the monitored object moved between time points and calculates the object's speed and direction. A spin calculator determines how much the object has rotated between time points and calculates the rotation rate, W, of the object. The rotation rate W may conveniently be described in terms of vector spin components about three mutually orthogonal spin axes, conventionally $\vec{I}$, $\vec{J}$ and $\vec{K}$, or may be described in polar form as a single magnitude and a resultant spin axis.

The above information about the launch of a golf ball, coupled with knowledge of the type of golf ball used, is sufficient for applicants to accurately predict the flight trajectory and point of landing of the golf ball. Similarly, information of this nature about the golf club enables applicants to diagnose problems in the golfer's swing preparatory to making recommendations for their correction.

Although the preceding has treated impact monitoring of the golf club and launch monitoring of the golf ball as separate processes, nothing in the foregoing should be taken to exclude combined impact and launch monitoring during a single golf swing. Combined monitoring may utilize some or all of the same electro-optical sensors.

The geometric calculations performed may be adapted to different surface shapes of club head and golf ball. Therefore the golfer's own clubs and/or balls may be used if desired provided, of course, the spots are added as discussed hereinbefore.

Additional useful data may be obtained by monitoring the club head at the instant of impact with the golf ball and at one or more points in time thereafter in addition to the two pre-impact or post-impact monitoring time points described in the preceding. Therefore, the present invention may conveniently extend the number and spacing of time points for monitoring the club head to include the moment of impact and one or more time points following impact.

While golf is certainly the primary application of the present invention, it may also advantageously be used to monitor other types of sports devices. For example, other ball-and-implement games such as baseball, tennis, and the like; non-ball games such as hockey; and ball-only games such as football, basketball and bowling may be advantageously monitored using the present invention.

BRIEF DESCRIPTION OF THE DRAWINGS

FIG. 2 shows a closeup of a ball being monitored by three electro-optical sensors.

FIG. 3 shows an orthogonal spin axis system.

DETAILED DESCRIPTION OF THE PREFERRED EMBODIMENT

Figure 1:
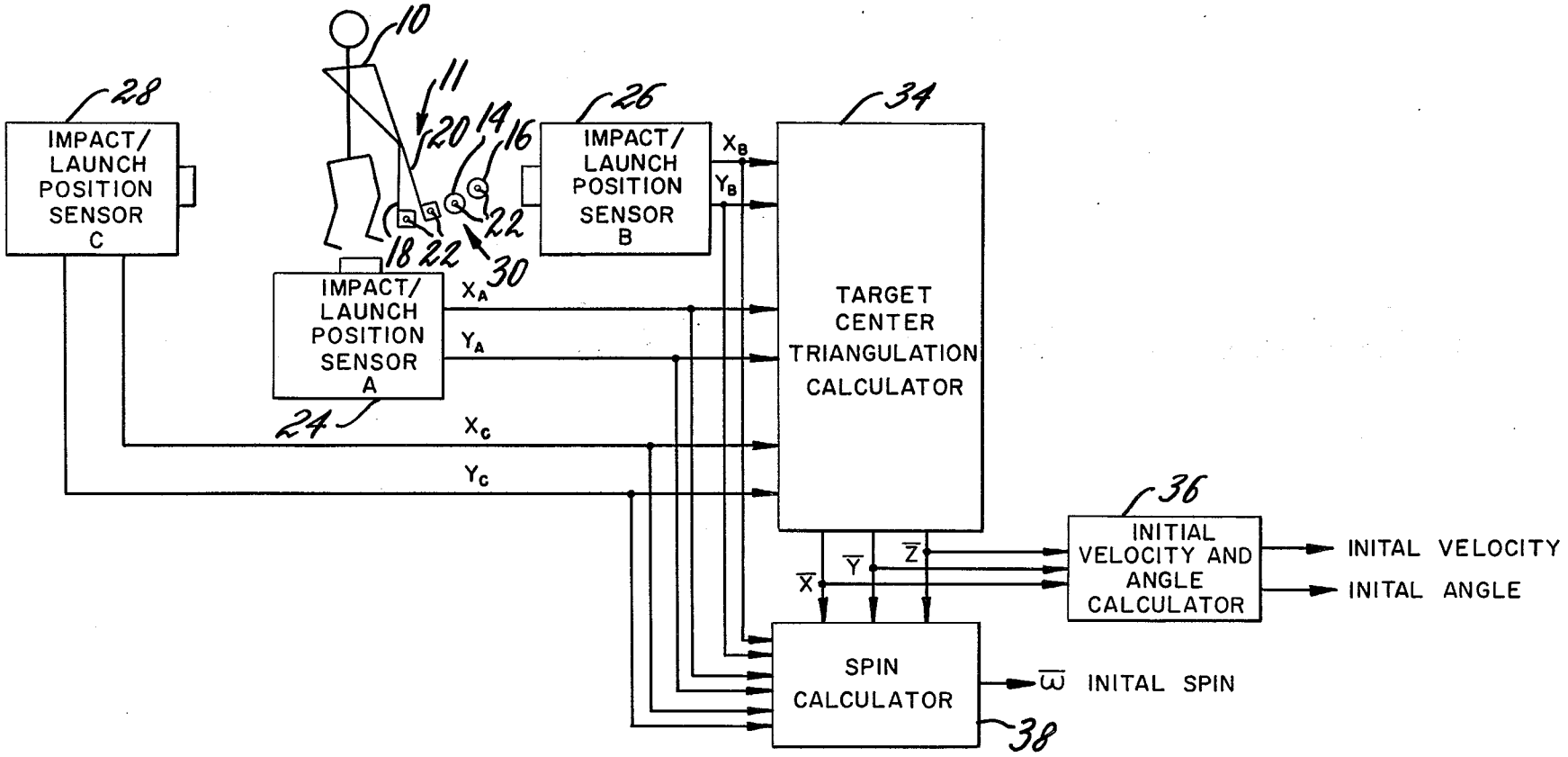
FIG. 1 shows an overall block diagram of the impact-/launch monitor.

Referring to FIG. 1, there is shown a golfer 10 holding a golf club 11 for hitting a golf ball 30. The golf club 11 occupies positions 18 and 20 at two closely spaced points in time before it strikes the ball 30. The golf ball occupies positions 14 and 16 at two closely spaced points in time after being struck by the golf club 11.

At least one optically enhanced spot 22 on the object being monitored is visible to each electro-optical launch/impact position sensor 24, 26, 28. In FIG. 1, the optically enhanced spot 22 is assumed to be the one visible to impact/launch position sensor A 24. Similar optically enhanced spots, not shown, are visible to impact/launch position sensor B 26 and to impact/launch position sensor C 28. The three impact/launch position sensors 24, 26 and 28 freeze the point on the object which they monitor at a minimum of two points in time and generate digital numbers indicative of the apparent position of the spot at each time point.

In the preferred embodiment, the optically enhanced spot 22 is retroreflective material. Although retroreflective techniques simplify the pattern recognition problem considerably by improving the optical contrast, the target spot may in general be a dot of a first optical reflectivity on a ball of different optical reflectivity. More complicated processing could extract the ball orientation information from low contrast targets. The golf ball dimples themselves may be considered of sufficiently different optical reflectivity from the ball surface to be marginally adequate indicators of ball orientation.

Referring momentarily to FIG. 2, the ball 30 having its center of gravity at 32 is viewed by the three impact-/launch position sensors 24, 26 and 28. Assume, for purposes of description, that FIG. 2 is a plan view. Each impact/launch position sensor 24, 26, 28 develops one of its two outputs in sensor coordinates $X_A$, $X_B$, $X_C$. Each X coordinate is related in a known manner to the angular displacement $\theta_A$ of the spot from the sensor axis. For example, the sensor coordinate $X_A$ from sensor 24 is related to angle $\theta_A$ from the sensor 24 axis to the spot 22. The second set of outputs $Y_A$, $Y_B$ and $Y_C$ in sensor coordinates are generated in a similar manner using the angles $\phi_A$, $\phi_B$ and $\phi_C$ (not shown) which can conveniently be normal to the plane defined by angles $\theta_A$, $\theta_B$ and $\theta_C$.

The displacement of the center of gravity 32 between time points defines the object velocity. Given the angle information in sensor coordinates, shown in FIG. 1, and knowing $\theta_A$, $\theta_B$ and $\theta_C$, the location of the spots on the ball 30, and its geometry, two dimensions of the center of gravity 32 of the ball 30 in unified coordinates can be uniquely calculated. Similarly, the third dimension can be uniquely calculated in unified coordinates using the normal angles $\phi_A$, $\phi_B$ and $\phi_C$. Unified coordinates as used in the foregoing is to be taken to mean any single common coordinate system determined by resolution of the individual data items in sensor coordinates into the common coordinate system. For example, a three-dimensional, cartesian coordinate system X', Y', Z' could be defined with its origin at impact/launch monitor sensor 24. Only the X' and Y' axes are shown. The Z' axis is assumed to be normal to the page. All measurements from impact/launch position sensors 26 and 28 would be resolved into the X', Y', Z' coordinate system using the known distances and angles between impact-/launch position sensors 24, 26 and 28. Thus the position of the center of gravity 32 would be determined in coordinates X', Y' and Z' at the two time points.

Referring again to FIG. 1, the target center triangulation calculator 34 performs the resolution of the sensor-coordinate measurements into unified coordinates and calculates the coordinates of the center of gravity 32 $\overline{X}$, $\overline{Y}$ and $\overline{Z}$.

The coordinates of the center of gravity 32, $\overline{X}$, $\overline{Y}$, $\overline{Z}$ are connected to an initial velocity and angle calculator 36 and a spin calculator 38. The spin calculator 38 also receives spot-position data indicating the positions of the spots 20, 20b and 20c on the surface of the ball 30. The spot-position data can be in sensor coordinates ($X_A$, $Y_A$), ($X_B$, $Y_B$) and ($X_C$, $Y_C$) or they may be in unified coordinates X', Y', Z' developed in the manner previously described. If the angle $\gamma$ in an arbitrary coordinate system changes by an amount $\Delta\gamma$ in the time $\Delta T$, between time points, the ratio $\Delta\gamma/\Delta T$ is approximately equal to $d\gamma/dt$ when the time points are close enough together. For the purposes of the present invention, $\Delta\gamma/\Delta T$ is a sufficiently accurate measure of $d\gamma/dT$ when $\Delta T$ between time points is less than about a tenth of a second.

Spin denoted by $\vec{W}$ is a vector quantity having both a scalar magnitude and direction. A single spin vector can be resolved into spin components, conventionally taken to be along three mutually orthogonal axes. FIG. 3 illustrates an orthogonal spin axis system having axes J, K and L. Conventionally, axis J is aligned with the X axis, K with the Y axis and L with the Z axis in a cartesian coordinate system. $\vec{W}_J$, for example, is the vector component of spin about the J spin axis. The spin of a projectile moving through a resisting medium, a golf ball through air for example, develops lift. The magnitude and direction of the lift depends on the magnitude of the spin, the orientation of the spin with respect to the relative air flow and the nature of the projectile-medium interface. The dimples at the ball-air interface of a golf ball are purposely provided to achieve desired values of lift.

Referring again to FIG. 1, the spin calculator 38 calculates the value of spin $\vec{W}$. The calculated spin may be either as a single resultant spin $\vec{W}$ or as orthogonal spin components $\vec{W}_J$, $\vec{W}_K$ and $\vec{W}_L$. The calculated initial spin is then made available to external devices (not shown).

The initial velocity and angle calculator 36 receives the two values of the ball centroid coordinates ($\overline{X}$, $\overline{Y}$, $\overline{Z}$). The component of displacement along each axis is the difference in the magnitude of the components along each axis occurring between the two time points. For example the $\overline{X}$ component of displacement is $\Delta\overline{X} = \overline{X}_2 - \overline{X}_1$; where $\overline{X}_1$ = first measured $\overline{X}$ $\overline{X}_2$ = second measured $\overline{X}$ The total displacement is $\sqrt{\Delta\overline{X}^2 + \Delta\overline{Y}^2 + \Delta\overline{Z}^2}$ The magnitude of the total initial velocity is thus $$V = \sqrt{\Delta\overline{X}^2 + \Delta\overline{Y}^2 + \Delta\overline{Z}^2}/\Delta T$$

Velocity $\vec{V}$ is also a vector quantity and can be resolved into components, conventionally along mutually orthogonal axes which lie along the X', Y' and Z' axes. The angle which one component of velocity makes with the plane defined by the axes of the other two components can be determined from the individual displacement components. For example, $$\text{the total loft angle} = \arctan\left(\Delta\overline{Z}/\sqrt{\Delta\overline{X}^2 + \Delta\overline{Y}^2}\right)$$

By calculations similar to those described, the components of velocity and loft angle along the coordinate axes may also be calculated.

The values of initial velocity and angles are connected from the initial velocity and angle calculator to external devices (not shown).

It will be understood that the claims are intended to cover all changes and modifications of the preferred embodiments of the invention, herein chosen for the purpose of illustration which do not constitute departures from the spirit and scope of the invention.

What is claimed is:

1. Apparatus for evaluating translational and rotational motion of at least one sports object comprising:

(a) at least two electro-optical monitoring means;

(b) means for optically enhancing at least one point on said object;

(c) said electro-optical monitoring means each providing an output at at least two discrete times, said output from each electro-optical monitoring means being related to the position within the field of view of each electro-optical monitoring means of said at least one point;

(d) first means, employing the outputs of said electro-optical monitoring means for calculating the spin of said object between said at least two discrete times; and (e) second means, based on the outputs of said electro-optical monitoring means for calculating the velocity and angle of velocity of said object between said at least two discrete times.

2. The apparatus recited in claim 1 wherein said means for optically enhancing is an area of optically retroreflective material affixed to the object.

3. The apparatus recited in claim 1 wherein said object is a golf club head.

4. The apparatus recited in claim 1 wherein said object is a golf ball.

5. The apparatus recited in claim 1 wherein said object is both a golf club head and a golf ball.

6. The apparatus recited in claim 1 wherein said at least one point comprises at least two spaced apart points on said object.

7. The apparatus recited in claim 1 wherein said at least one point comprises at least three spaced apart points on said object.

8. The apparatus recited in claim 7 wherein said at least two electro-optical monitoring means comprises at least three electro-optical monitoring means.

9. A golf ball launch monitoring system comprising:

(a) at least one optical target affixed to said golf ball;

(b) electro-optical position sensing means for producing a plurality of outputs related to the sensor coordinate positions of said target as seen from at least one angle at at least two discrete closely spaced time points;

(c) target center calculation means for calculating the centroid of said golf ball based upon said plurality of outputs;

(d) spin calculating means for calculating the spin of said golf ball based upon said plurality of outputs; and (e) initial velocity and angle calculating means for calculating the initial velocity and initial flight angle of said golf ball based upon said plurality of outputs.

10. A golf club head impact monitoring system comprising:

(a) at least one spot of optically retroreflective material affixed to said golf club head;

(b) electro-optical position sensing means for producing a plurality of outputs related to the apparent positions of said at least one spot as seen from a plurality of angles at at least two discrete closely spaced time points;

(c) target center triangulation calculation means for calculating a fixed point with respect to said golf club head based upon said plurality of outputs;

(d) means for calculating the rotational motion of said golf club head based upon said plurality of outputs; and (e) velocity and angle calculating means for calculating the velocity vector of said golf club head immediately prior to impact based upon said plurality of outputs.

11. Apparatus for evaluating translational and rotational motion of a golf ball comprising:

(a) at least one electro-optical monitoring means;

(b) means for optically enhancing at least one point on said object;

(c) said electro-optical monitoring means providing an output at at least one discrete time, said output being related to the position within the field of view of said at least one electro-optical monitoring means of said at least one point;

(d) first means, based on the outputs of said at least one electro-optical monitoring means for calculating the component of spin of said object in at least one plane between a known time and said at least one discrete time; and (e) second means, based on the outputs of said at least one electro-optical monitoring means for calculating the velocity and angle of velocity of said object in said at least one plane between said known time and said at least one discrete time.

12. A golf ball launch monitoring system comprising:

(a) at least three spaced-apart electro-optical monitoring means having fields of view;

(b) at least three optically enhanced retroreflective spots on said golf ball;

(c) said electro-optical monitoring means each being operative to provide an output at at least two discrete times, said output being related to the position within the field of view of each electro-optical monitoring means of the one or more of said spots which is in its field of view;

(d) target center triangulation calculator means for calculating the location of the center of said golf ball at said at least two discrete times, said calculating being based on said outputs;

(e) spin calculator means for calculating the spin of said golf ball at least between said two discrete times, said calculating the spin being based on said outputs; and (f) initial velocity and angle calculator means for calculating the velocity angle of said golf ball at least between said two discrete times, the velocity calculation being based on the calculated displacement of the target center.

* * * * *